United States Patent [19]

Dennison

[11] 3,976,404

[45] Aug. 24, 1976

[54] LUBRICATION OF COMPRESSION SEALS IN ROTARY ENGINES

[75] Inventor: Thomas M. Dennison, Peoria, Ill.

[73] Assignee: Caterpillar Tractor Co., Peoria, Ill.

[22] Filed: Feb. 19, 1975

[21] Appl. No.: 551,177

[52] U.S. Cl. ..... 418/88; 418/94; 418/97

[51] Int. Cl.[2] ..... F01C 21/04

[58] Field of Search ..... 418/88, 91, 97, 94, 418/87

[56] References Cited

UNITED STATES PATENTS

| | | | |
|---|---|---|---|
| 2,669,384 | 2/1954 | Dills | 418/88 |
| 3,042,009 | 7/1962 | Froede et al. | 418/94 |
| 3,261,334 | 7/1966 | Paschke | 418/91 |
| 3,343,526 | 9/1967 | Peras | 418/94 |
| 3,390,667 | 7/1968 | Beurtheret | 418/94 |
| 3,445,058 | 5/1969 | Bensinger | 418/91 |
| 3,583,371 | 6/1971 | King | 418/88 |
| 3,705,570 | 12/1972 | Ruf | 418/94 |
| 3,771,501 | 11/1973 | DeBobo | 418/94 |

*Primary Examiner*—C. J. Husar

*Attorney, Agent, or Firm*—Wegner, Stellman, McCord, Wiles & Wood

[57] ABSTRACT

An improved means for lubricating the compression seals of rotary engines. The system is provided in a typical rotary engine having a housing with a main shaft extending through the housing and a rotor within the housing and journalled on the main shaft. The rotor includes a bore receiving the shaft. Conventional means are provided for supplying lubricant to the interface of the main shaft and the rotor at the bore. The rotor carries at least one compression seal and is provided with a lubrication conduit for the seal extending from the bore to a surface of the rotor adjacent the seal. During operation of the engine, relative rotation between the rotor and the shaft takes place and generates a pumping action at the interface to drive small amounts of lubricant through the lubrication conduit to the rotor surface to lubricate the seal.

8 Claims, 2 Drawing Figures

LUBRICATION OF COMPRESSION SEALS IN ROTARY ENGINES

BACKGROUND OF THE INVENTION

This invention relates to rotary engines, and, more particularly, to improved means for lubricating the compression seals of rotary engines.

While the principles of construction and operation of various forms of rotary engines, such as so-called "Wankel" engines or slant axis rotary engines have long been known, such engines have not been commercialized to an appreciable extent. A principal obstacle to commercialization of such engines resides in an inability to maintain good sealing engagement between seals carried by the rotor and the engine housing. It has been difficult to provide consistent and reliable lubrication of such compression seals with the consequence that the same have worn out prematurely, resulting in high maintenance costs and low reliability to the point that such engines have not met with appreciable commercial success.

SUMMARY OF THE INVENTION

It is the principal object of the invention to provide a new and improved rotary engine. More specifically, it is an object of the invention to provide an improved means of lubricating the compression seals of rotary engines to enhance their life and, thus, reliability of the engine.

An exemplary embodiment of a rotary engine incorporating a lubricating system made according to the invention includes a housing with a main shaft extending through the housing. A rotor is journalled on the main shaft and has a bore receiving the shaft. Conventional means for lubricating the interface of the bore and the shaft are provided.

At least one compression seal is carried by the rotor and sealingly engages the housing. A lubrication conduit is located in the rotor and extends from the bore to a surface on the rotor adjacent the compression seal.

As a consequence, upon relative rotation between the rotor and the shaft during operation of the engine, a pumping action will be generated at the interface to drive small amounts of lubricant thereat through the lubrication conduit to the rotor surface to lubricate the seal.

In a preferred embodiment, a lubricant flow regulating means is located in the conduit. According to one embodiment, flow regulation is achieved by a check valve which is operative to allow lubricant to flow from the interface to the rotor surface but not in the reverse direction. Preferably, the check valve is normally closed and is constructed and arranged to open at a predetermined pressure in excess of the operating pressure of the lubricating means, normally, the usual oil pump accompanying such an engine. A biasing means, such as a spring, may be employed to determine the pressure at which the check valve will open.

The invention may be employed in all forms of rotary engines as, for example, a so-called "Wankel" engine or a slant axis rotary engine. The rotor surface to which the lubrication conduit opens may be either a side surface or a radially outer surface relative to the rotor bore.

Other objects and advantages will become apparent from the following specification taken in connection with the accompanying drawings.

DESCRIPTION OF THE PREFERRED EMBODIMENTS

Figure 1:
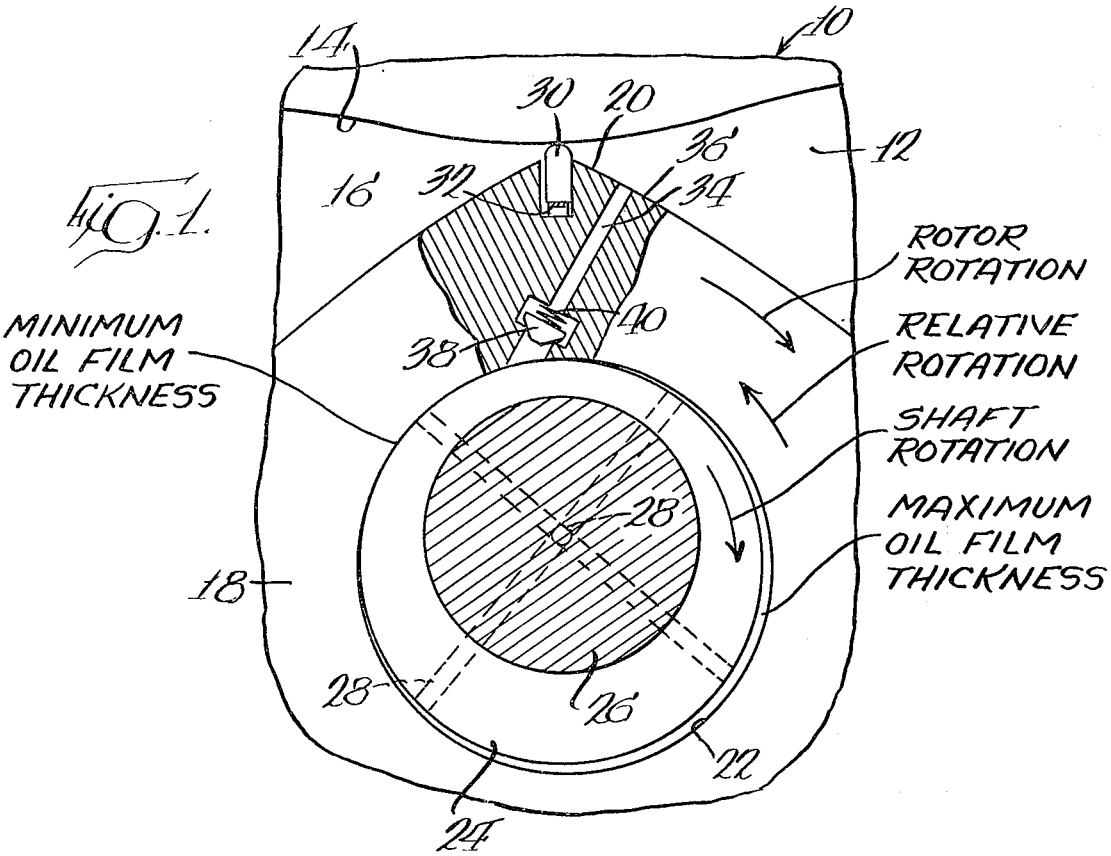
FIG. 1 is a somewhat schematic view of one embodiment of a rotary engine embodying the invention with parts broken away for clarity and the interrelationship of various components exaggerated to enhance the understanding of the invention.

One embodiment of a lubricating system for a rotary engine is illustrated in FIG. 1 in connection with the lubrication of an apex seal for a so-called "Wankel" engine. Before proceeding further with the description thereof, it is to be expressly understood that no restriction to any particular form of a rotary engine is intended herein, the embodiments illustrated merely being exemplary of the principles of the invention. Those skilled in the art will immediately recognize that the invention can be employed with a great variety of forms of rotary engines and is not restricted to the form illustrated.

The engine includes a housing, generally designated 10, having an internal chamber 12 defined by a radially outer wall 14, the configuration of which will be defined by the particular type of engine in which the invention is being employed, and a pair of side walls 16 (only one of which is shown), again, the configuration of which will depend upon the type of engine in which the invention is being employed.

Within the chamber 12, a rotor 18 having plural apices 20 (only one of which is shown) is located. The rotor 18 is provided with a bore 22 for journalling receipt of the eccentric 24 of a main shaft 26 which passes through the housing 10. Suitable bearings (not shown) may be located at the interface between the bore 12 and the eccentric portion 24 of the main shaft 26.

Conventional means are employed for directing lubricant to the aforementioned interface and the same are schematically illustrated as passages 28. An oil pump or the like will normally be employed to direct oil under pressure through the passages 28 to the interface at relatively low pressure, normally, 20–80 psig.

In an engine of the type shown, the shaft 28 will rotate in the direction of an arrow bearing the legend "Shaft Rotation" at a first rate while the rotor will be driven in the same direction as indicated by an arrow bearing the legend "Rotor Rotation" at a lesser rate. As a consequence, the relative rotation between the shaft 26 and the rotor 18 will be in the opposite direction as indicated by an arrow bearing the legend "Relative Rotation".

It will also be recognized that conventionally high combustion pressures will be acting on the left side of the rotor 18. Furthermore, it will be recognized that due to design parameters, the internal diameter of the bore 22 (or bearings affixed thereto) will be slightly larger than the external dimension of the eccentric portion 24 of the main shaft 26 (or bearings affixed thereto). Such design factors result in a certain amount of play between the rotor 18 and the shaft 26 and by reason of the direction upon which high pressure gases act upon the rotor 18, the rotor 18 will assume a position with respect to the shaft 26 and the eccentric portion 24 thereof as that illustrated in somewhat exaggerated form in FIG. 1. As a consequence, and as indicated by legends in FIG. 1, there will be a region of minimal oil film thickness adjacent the upper and left-hand portions of the shaft bore interface while a region of maximum oil film thickness will be opposite therefrom at the interface. The lubrication system of the engine employing the passages 28 will essentially always fill the clearance between the eccentric portion 24 and the bore 22 with oil and by reason of the fact that the oil film transmits the load on the rotor to the main shaft 26, a high film pressure will be present at that portion of the oil film which transmits such loads. Consequently, at the region of minimum oil film thickness, a high film pressure will exist which will be in the range of a few thousand kilopascals to three hundred thousand kilopascals or more.

While the pressure developed is quite high, because of the minimal thickness of the oil film, small quantities of oil are present. The quantity of oil available is commensurate with the quantity of oil to desirably be delivered to compression seals for lubrication of the latter.

In FIG. 1, a compression seal in the form of an apex seal 30 is provided at the apex 20 of the rotor 18. A biasing spring 32 may be employed to bias the seal 30 into sealing engagement with the wall 14 of the housing 10. Of course, seals 30 and springs 32 will be provided at each of the other apices 20 (not shown) on the rotor 18 as will an oil delivery system such as that now to be described.

The rotor 18 is provided with a lubrication conduit 34 which extends from the bore 22 in the rotor to a radially outer surface 36 of the rotor 18 adjacent each of the seals 20. As a consequence of the previously described construction, pumping action on lubricant at the interface of the bore 22 and the shaft 26 caused by the relative rotation between the two along with the high pressure of the oil at the region of minimum oil film thickness, will cause small quantities of oil to be delivered to a point adjacent the seal 30 to lubricate the same.

Preferably, flow regulating means are employed in connection with the conduit 34 and, as illustrated in FIG. 1, such means are defined by a normally closed check valve 38 backed by a spring 40. The check valve 38 and spring 40 may be set to open at relatively high pressures to thereby regulate the amount of oil being transmitted to the surface 36. In addition, the check valve 38 will preclude flow of fluid from the surface 36 to the interface of the shaft 26 and the bore 20 thereby preventing combustion gases from blowing back into the system. By presetting the pressure at which the check valve 38 will open, preferably at a level in excess of the pressure at which oil is delivered through the passages 28, the check valve 38 will also prevent oil from leaking into the chamber due to oil pump pressures or centrifugal force.

By suitably adjusting the opening pressure of the check valve 38 by regulating the degree of bias provided by the spring 40, the amount of oil delivered per revolution of the engine may be varied over wide limits to suit a variety of applications. Similarly, oil flow control may be achieved by appropriate adjustment of bearing clearances as well as by varying the location of the conduit 34 at its point of emergence into the bore 22.

It will also be recognized that the system is selfcompensating in terms of engine velocity. The pumping action principle employed insures that oil delivery increases with rotor speed.

Figure 2:
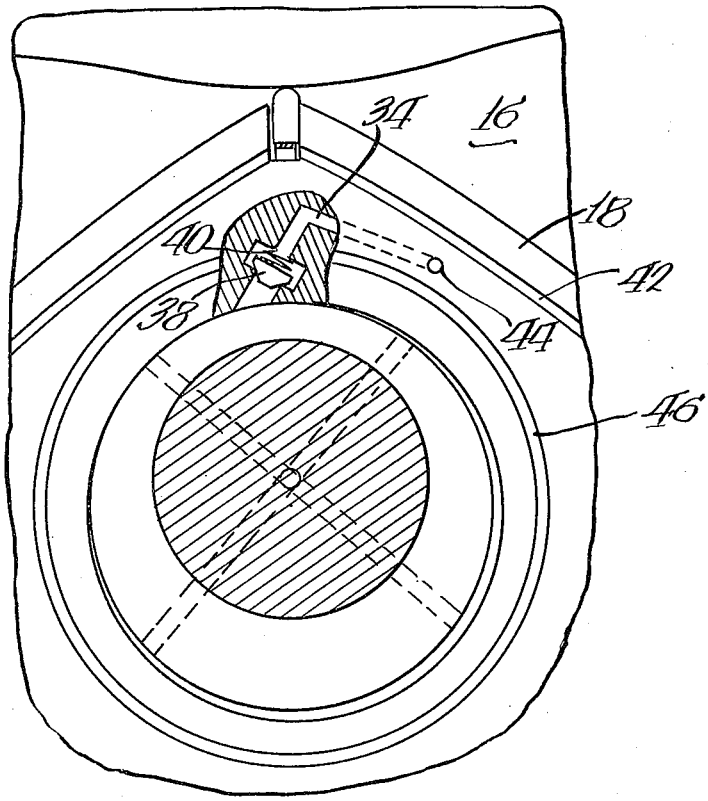
FIG. 2 is a similar view of a modified embodiment of a rotary engine embodying the invention.

Turning now to FIG. 2, if desired, other types of compression seals, such as a side seal 42 carried by the rotor 18 and engaging one of the side walls 16 (not shown), may be lubricated. In this case, the lubricant conduit 34 is directed to an emerging port 44 on a side surface of the rotor 18 at a location between the aforementioned side seal 42 and the customary oil seal 46. Centrifugal force will cause oil emanating from the port 44 to migrate to the side seal 42 and lubricate the same. If desired, the port 44 could be located radially outwardly of the side seal 42, the rotation of the rotor 18 causing oil movement to the seal 42 for lubrication.

It will also be recognized that, if desired, both the apex seals 30 and the side seals 42 could be lubricated either through the use of a common lubricant conduit 34 or individual, spaced conduits separated axially and/or radially along the rotor according to the degree of lubrication desired.

What is claimed is:

1. In a rotary engine, the combination of a housing, a main shaft extending through said housing, a rotor journalled on said main shaft, said rotor having a bore receiving said shaft, means for lubricating the interface of said bore and said shaft, at least one compression seal carried by said rotor and sealingly engaging said housing, and a lubrication conduit in said rotor extending from said bore to a surface of said rotor adjacent said compression seal, whereby relative rotation between said rotor and said shaft during operation of said engine will generate a pumping action at said interface to drive small amounts of lubricant through said lubrication conduit to said rotor surface to lubricate said seal.

2. The rotary engine of claim 1 further including lubricant flow regulating means in said conduit.

3. The rotary engine of claim 2 wherein said flow regulating means comprises a check valve operative to allow lubricant to flow from said interface to said rotor surface but not in the reverse direction.

4. The rotary engine of claim 3 wherein said check valve is normally closed and is constructed and arranged to open at a predetermined pressure in excess of the operating pressure of said lubricating means.

5. The rotary engine of claim 2 wherein said rotor surface is a side surface.

6. The rotary engine of claim 2 wherein said rotor surface is a radially outer surface relative to said bore.

7. A rotary engine comprising the combination of: a housing; a main shaft extending through said housing; a rotor journalled on said main shaft and within said housing, said rotor having a bore receiving said shaft; means for lubricating the interface of said bore and said shaft; at least one compression seal carried by said rotor and sealingly engaging said housing; a lubrication conduit in said rotor extending from said bore to a surface of said rotor adjacent said compression seal; a normally closed check valve in said conduit for allowing lubricant to flow from said interface to said rotor surface while precluding flow of fluid in the opposite direction; and means for allowing lubricant to flow from said interface to said rotor surface only when a predetermined pressure at said interface exists or is exceeded.

8. The rotary engine of claim 7 wherein said means for allowing the flow of lubrication comprises biasing means for said check valve.

* * * * *